US006033839A

United States Patent [19]

Smith et al.

[11] Patent Number: 6,033,839

[45] Date of Patent: Mar. 7, 2000

[54] POLYMERIC MATTE PARTICLES

[75] Inventors: Dennis E. Smith, Rochester; Sharon M. Melpolder, Hilton; John L. Muehlbauer, Stafford, all of N.Y.

[73] Assignee: Eastman Kodak Company, Rochester, N.Y.

[21] Appl. No.: 09/082,012

[22] Filed: May 20, 1998

[51] Int. Cl.[7] ..... G03C 1/95; G03C 1/76; G03C 11/06

[52] U.S. Cl. ..... 430/496; 430/523; 430/536; 430/537; 430/950; 430/961

[58] Field of Search ..... 430/536, 537, 430/950, 961, 523, 496

[56] References Cited

U.S. PATENT DOCUMENTS

| | | | |
|---|---|---|---|
| 3,080,254 | 3/1963 | Grant | 430/616 |
| 3,457,075 | 7/1969 | Morgan et al. | 430/619 |
| 3,933,508 | 1/1976 | Ohkubo et al. | 430/619 |
| 4,022,622 | 5/1977 | Timmerman et al. | 430/537 |
| 4,447,525 | 5/1984 | Vallarino et al. | 430/950 |
| 4,741,992 | 5/1988 | Przezdziecki | 430/523 |
| 4,828,971 | 5/1989 | Przezdziecki | 430/531 |
| 4,855,219 | 8/1989 | Bagchi et al. | 430/496 |
| 4,942,115 | 7/1990 | Przezdziecki | 430/619 |
| 5,264,334 | 11/1993 | Przezdziecki et al. | 430/619 |
| 5,310,640 | 5/1994 | Markin et al. | 430/619 |
| 5,330,885 | 7/1994 | Takamuki | 430/537 |
| 5,374,498 | 12/1994 | Fujita et al. | 430/950 |
| 5,393,649 | 2/1995 | Bauer et al. | 430/523 |
| 5,418,120 | 5/1995 | Bauer et al. | 430/523 |
| 5,422,234 | 6/1995 | Bauer et al. | 430/523 |
| 5,547,821 | 8/1996 | Melpolder et al. | 430/527 |
| 5,563,226 | 10/1996 | Muehlbauer et al. | 526/173 |
| 5,698,384 | 12/1997 | Anderson et al. | 430/537 |
| 5,750,328 | 5/1998 | Melpold et al. | 430/536 |
| 5,750,378 | 5/1998 | Goodheart et al. | 435/70.3 |
| 5,866,312 | 2/1999 | Wang et al. | 430/537 |

FOREIGN PATENT DOCUMENTS

| | | |
|---|---|---|
| 370405 | 5/1990 | European Pat. Off. . |
| 94/11198 | 5/1994 | WIPO . |

OTHER PUBLICATIONS

Research Disclosure, Jun. 1978, Item No. 17029 pp 9–15.

*Primary Examiner*—Richard L. Schilling
*Attorney, Agent, or Firm*—Edith A. Rice

[57] ABSTRACT

This invention comprises a thermally processable imaging element comprising:

(1) a support;

(2) a thermally processable imaging layer on one side of the support; and (3) a protective layer comprising:

(A) a film-forming binder;

(B) matte particles comprising a core surrounded by said film-forming binder.

10 Claims, No Drawings

POLYMERIC MATTE PARTICLES

FIELD OF THE INVENTION

This invention relates a thermally processable imaging element comprising polymeric matte particles in at least one layer thereof.

BACKGROUND OF THE INVENTION

Thermally processable imaging elements, including films and papers, for producing images by thermal processing are well known. These elements include photothermographic elements in which an image is formed by imagewise exposure of the element to light followed by development by uniformly heating the element. These elements also include thermographic elements in which an image is formed by imagewise heating the element. Such elements are described in, for example, *Research Disclosure*, June 1978, Item No. 17029 and U.S. Pat. Nos. 3,080,254, 3,457,075 and 3,933, 508.

The aforesaid thermally processable imaging elements are often provided with at least one protective layer. The protective layer can be a overcoat layer or a backing, or the element may have both a protective overcoat layer and a protective backing layer. The overcoat layer is an outer layer on the side of the support on which the imaging layer is coated and the backing layer is an outer layer on the opposite side of the support. Generally these layers are the outermost layers of the element. Other layers which are advantageously incorporated in thermally processable imaging elements include subbing layers and barrier layers.

To be fully acceptable, a protective layer for such imaging elements should: (a) provide resistance to deformation of the layers of the element during thermal processing, (b) prevent or reduce loss of volatile components in the element during thermal processing, (c) reduce or prevent transfer of essential imaging components from one or more of the layers of the element into the overcoat layer during manufacture of the element or during storage of the element prior to imaging and thermal processing, (d) enable satisfactory adhesion of the protective layer to a contiguous layer of the element, (e) be free from cracking and undesired marking, such as abrasion marking, during manufacture, storage, and processing of the element, (f) provide adequate conveyance characteristics during manufacture and processing of the element, (g) not allow blocking, ferrotyping adhering or slippage of the element during manufacture, storage, or processing and (h) not induce undesirable sensitometric effects in the element during manufacture, storage or processing.

A protective layer also serves several important functions which improve the overall performance of thermally processable imaging elements. For example, the protective layer serves to improve conveyance, reduce static electricity, reduce dirt and eliminate formation of Newton Rings.

A typical protective layer for thermally processable imaging elements comprises poly(silicic acid) as described in U.S. Pat. Nos. 4,741,992, 4,828,971, 5,310,640 and 5,547, 821. Advantageously, water-soluble hydroxyl-containing monomers or polymers are incorporated in the protective layer together with the poly(silicic acid).

With photothermographic elements, it is usually necessary to produce a "duplicate image" of that on the imaging element for low cost dissemination of the image. The duplication process is typically a "contact printing" process where intimate contact between the photothermographic imaging element and the duplication imaging element is essential. Successful duplication of either continuous rolls or cut sheets is dependent on adequate conveyance of the imaging element through the duplication equipment without the occurrence of slippage or sticking of the protective overcoat layer of the photothermographic imaging element in relation to any of (1) the duplication equipment, (2) the duplication imaging element or (3) the backing layer of subsequent portions of the photothermographic imaging element (adjacent convolutions of the photothermographic imaging element if in a continuous roll or adjacent "cut sheets" in a stacking configuration). The latter of these phenomena is often referred to as "blocking".

The addition of matte particles to either or both protective layers of a thermally processable element is commonly used to prevent adhering or "blocking" between the protective overcoat layer and adjacent backing layer with which it is in intimate contact during manufacture, storage, processing and photo duplication. Furthermore, the matte particles are desirable to impart desired frictional characteristics to the protective overcoat and/or layer to achieve proper conveyance without sticking, blocking or slippage during the duplication process. The amount and particle size of the matte must be controlled as the wrong particle size and/or amount can cause both conveyance and duplicate image quality problems. Anther problem associated with the use of matte particles in protective layers of a thermally processable imaging elements is dusting that comes from inadequate adhesion between the matte particles and the binder.

The properties of mattes are very important to their incorporation into film products. The matte improves or tailors the transport properties of the final film product and can also provide increased protection from ferrotyping and blocking of the raw and processed film. The glass transition temperature (Tg) and composition of the matte determines the effect of processing conditions on the final matte properties, i.e. swellability, size, surface roughness, etc.

Three very important properties of a matte that determines which is best suited for use in a particular product application are:

1. particle size and size distribution
2. ease of dispersability in coating solutions
3. stability of matte to manufacturing and processing conditions to control agglomeration, swelling, "squashing", and suspension in coating solutions.

The use of limited coalescence made mattes as described in U.S. Pat. No. 5,750,378 has greatly improved particle size distribution and has resulted in a decrease of the over-size population of the as-made matte. This property allows us to use mattes without additional classification to remove the unwanted larger sized particles which in the case of films which use magnification of the final product could give unacceptable visual appearance of the final product.

The use of methyl methacrylate and other high Tg polymers with and without cross-linking provides a matte that does not change in dimensions in systems when the matte is exposed to high processing temperatures, i.e. near the Tg of the matte.

The addition of a shell to the above particle can greatly improve the adhesion of matte particles to hydrophilic binder as described in U.S. Pat. No. 5,563,226. The shell also improves re-dispersion of the matte particles in a photographic coating composition. In particular, a gelatin shell provides a matte suspension which "gels" around room temperature and has a matte distribution which is constant throughout the suspension. The matte particles taught in the '226 patent are utilized in photographic elements in which they are used in a layer having a hydrophilic binder, preferably gelatin.

Unfortunately, in some cases we have found that the use of matte particles having a gelatin shell causes an interaction under certain conditions. In particular, when mattes having a gelatin shell are added to a binder system other than gelatin agglomeration was found to occur. For example, when the binder system comprises poly(vinyl alcohol) we found that agglomeration occurred under the following conditions:

1. pH greater than 3.0 (the agglomeration is reversible when the pH is reduced)
2. bacterial or fungal growth of the binder
3. when certain dyes are added, the matte aggregates and then congregates on undissolved dye particles.

In thermally processable imaging elements the matte is generally incorporated into a layer in which the binder is other than gelatin. This can result in agglomeration of the matte particles. Our invention overcomes the disadvantages encountered when matte particles are used with a binder other than gelatin while maintaining the advantages of the matte particles disclosed in the '226 patent. Further, our invention also inhibits agglomeration of the matte when a dye is added to the protective layer.

SUMMARY OF THE INVENTION

We have discovered that the above disadvantages and other matte interactions are overcome by the use of matte particles having a shell made of a composition similar to the polymeric binder of the layer of the thermally processable imaging element in which they are incorporated.

One aspect of this invention comprises a thermally processable imaging element comprising:

(1) a support;

(2) a thermally processable imaging layer on one side of the support;

(3) a protective layer comprising:

(A) a film-forming binder;

(B) matte particles comprising a core surrounded by said film-forming binder.

In preferred embodiments of the invention the film-forming binder comprises poly(vinyl alcohol) and may also contain poly(silicic acid).

During the manufacture of the thermally processable imaging element, the protective layer is applied as a suspension comprising matte particles in an aqueous medium containing the film-forming binder.

ADVANTAGEOUS EFFECT OF THE INVENTION

This invention provides a thermally processable imaging element having a, protective layer containing matte particles in which the matte particles have little, if any, tendency to agglomerate. In particular this invention provides a matte/binder system which is not sensitive to pH. This is extremely important as different components are often added to a formulation to optimize specific film properties of the final layer. These additional chemicals may perturb the system sufficiently to destabilize the melt and cause matte agglomeration. One example is the addition of a dye to the coating composition used to prepare the protective layer.

DETAILED DESCRIPTION OF THE INVENTION

The term "protective layer" is used in this application to mean an image insensitive layer which can be an overcoat layer, that is a layer that overlies the image sensitive layer(s), or a backing layer, that is a layer that is on the opposite side of the support from the image sensitive layer(s). The imaging element can have a protective overcoat layer and/or a protective backing layer and/or an adhesive interlayer. The protective layer is not necessarily the outermost layer of the imaging element. The protective layer is preferably transparent or translucent.

The protective layer comprises a film-forming binder comprising a water-soluble polymer such as poly(vinyl alcohol), acrylamide polymers, water soluble cellulose derivatives, such as water soluble cellulose acetate, and hydroxy ethyl cellulose acetate and the like. These water-soluble polymers are well known in the art and are commercially available.

In preferred embodiments of the invention, the binder also comprises poly(silicic acid). Thermally processable imaging elements having a protective layer comprising poly(silicic acid) and a hydroxyl containing monomer or polymer, such as poly(vinyl alcohol), are described in the above-mentioned US Pat. Nos. 4,741,992, 4,828,971, 5,310,640 and 5,547,821, the entire disclosures of which are incorporated herein by reference.

The protective layer in accordance with this invention also comprises matte particles. The matte particles comprise a core surrounded by the same material as the film-forming binder. The core of the matte particles can be either organic or inorganic matte particles. Examples of organic matte particles are often in the form of beads, of polymers such as polymeric esters of acrylic and methacrylic acid, e.g., poly (methylmethacrylate), styrene polymers and copolymers, and the like. Examples of inorganic matte particles are of glass, silicon dioxide, titanium dioxide, magnesium oxide, aluminum oxide, barium sulfate, calcium carbonate, and the like. Matte particles and the way they are used are further described in U.S. Pat. Nos. 3,411,907 and 3,754,924.

The shell of film-forming binder material generally can not be formed on the matte particles merely by contacting a pre-formed core with the binder material. Instead, conditions need to be established where the film forming binder polymer chemically reacts with the matte particle surface or is strongly adsorded. Such conditions are known to one skilled in the art and are difficult to achieve, requiring either a chemically reactive matte surface and binder polymer, or an in depth understanding of the complex adsorption phenomena involved. In preferred embodiments of the invention, the core comprises an organic polymer core which is prepared in the presence of the binder material so that the shell of film forming binder polymer is formed during matte particle synthsis rather than added afterwards.

The matte particles which are especially useful in this invention have an organic polymer core that can be prepared by pulverizing and classification of organic compounds, by emulsion, suspension, and dispersion polymerization of organic monomers, by spray drying of a solution containing organic compounds, and by a polymer suspension technique which consists of dissolving an organic material in a water immiscible solvent, dispersing the solution as fine liquid droplets in aqueous solution, and removing the solvent by evaporation or other suitable techniques. The bulk, emulsion, dispersion, and suspension polymerization procedures are well known to those skilled in the polymer art and are taught in such textbook as G. Odian in "Principles of Polymerization", 2nd Ed. Wiley (1981), and W. P. Sorenson and T. W. Campbell in "Preparation Method of Polymer Chemistry", 2nd Ed, Wiley (1968).

A preferred method of preparing matte particles in accordance with this invention is by a process which includes forming a suspension or dispersion of ethylenically unsaturated monomer droplets in an aqueous medium where the aqueous medium contains an effective amount of the desired binder and polymerizing the monomer to form solid polymer particles. It is especially preferred to add the binder to the aqueous media subsequent to the formation of the droplets and before the commencement of the polymerization reaction.

Any suitable ethylenically unsaturated monomer or mixture of monomers may be used in the practice of this invention, such as, vinyl substituted aromatic compounds, such as styrene, vinyl toluene, p-chlorostyrene, vinylbenzylchloride or vinyl naphthalene; ethylenically unsaturated mono-olefins, such as ethylene, propylene, butylene, or isobutylene; vinyl halides, such as vinyl chloride, vinyl bromide, vinyl fluoride; vinyl esters, such as, vinyl acetate, vinyl propionate, vinyl benzoate, or vinyl butyrate; esters of α-methylene monocarboxylic acids, such as methyl acrylate, ethyl acrylate, n-butyl acrylate, n-octyl acrylate, 2-chloroethyl acrylate, phenyl acrylate, methyl-α-chloroacrylate, methyl methacrylate, ethyl methacrylate, butyl methacrylate; acrylonitrile, methacrylonitrile, acrylamide, isopropylacrylamide, dimethylacrylamide; vinyl ethers, such as vinyl methyl ether, vinyl isobutyl ether, and vinyl ethyl ether; vinyl ketones, such as vinyl methyl ketone, vinyl hexyl ketone, and methyl isopropenyl ketone; acrolein; vinylidene halides, such as vinylidene chloride and vinylidene chlorofluoride; and Nvinyl compounds such as N-vinylpyrrolidone, N-vinyl pyrrole, N-vinyl carbazole, and N-vinyl indole; mixtures thereof and the like.

If desired, a suitable crosslinking monomer may be used in forming polymer droplets by polymerizing a monomer or monomers within droplets in accordance with this invention to thereby modify the polymeric particle and produce particularly desired properties. Typical crosslinking monomers are aromatic divinyl compounds such as divinylbenzene, divinylnaphthalene or derivatives thereof; diethylene carboxylate esters and amides such as diethylene glycol bis (methacrylate), diethylene glycol diacrylate, and other divinyl compounds such as divinyl sulfide or divinyl sulfone compounds.

A catalyst or initiator which is soluble in the monomer droplets may be utilized in the preferred method of preparing matte particles in accordance with this invention. Typical initiators for polymerization are the peroxide and azo initiators. Among those found suitable for use in the process of the invention are 2,2' azobis (2,4-dimethyl valeronitrile), 2,2' azobis (isobutyronitrile), lauroyl peroxide, benzoyl peroxide and the like which result in complete polymerization without leaving detrimental residual materials. Chain transfer agents may also be added to the monomer to control the properties of the polymer particles formed.

Any suitable suspension stabilizing agent may be used such as, for example, anionic particulate suspension stabilizing agents such as, silica, clays, talcs, and the like, as set forth in U.S. Pat. No. 5,288,598 herein incorporated by reference; surfactants including anionic, cationic and nonionic surfactants, such as sulfonated alkyl aryl polyethers, ethylene glycol ethers of polyhydric alcohols, carboxy alkyl-substituted polyglycol ethers and esters, fluoro-substituted compounds, sucrose esters of aliphatic acids, maleic ester amides, sodium salt of the condensation product of naphthalene sulfonic acid and formaldehyde, phosphate esters of glycidol polyethers, long chain sucrose ethers, higher alcohol sulfates, water soluble salts of aliphatic esters of sulfosuccinic acid, fatty acid esters of hydroxy alkyl sulfonic acids, amide and ester derivatives of sulfo-acetic acid, alpha-sulfo lower alkyl esters of C7 to 18 carbon atoms, fatty acids, and sulfate ester products of a glycidol polyether, and the like. Suitable surfactants are described in Section 11 of Research Disclosure 308119 published December 1989. A preferred surfactant is sodium dioctyl sulfosuccinate.

Preferred polymers which can comprise the organic polymer core are: olefin homopolymers and copolymers, such as polyethylene, polypropylene, polyisobutylene, polyisopentylene and the like; polyfluoroolefins such as polytetrafluoroethylene, polyvinylidene fluoride and the like, polyamides, such as, polyhexamethylene adipamide, polyhexamethylene sebacamide and polycaprolactam and the like; acrylic resins, such as polymethylmethacrylate, polyacrylonitrile, polymethylacrylate, polyethylmethacrylate and styrenemethylmethacrylate or ethylene-methyl acrylate copolymers, ethylene-ethyl acrylate copolymers, ethylene-ethyl methacrylate copolymers, polystyrene and copolymers of styrene with unsaturated monomers, polyvinyltoluene, cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride and vinyl acetate and polyvinyl butyral, poly(vinyl alcohol), polyvinyl acetal, ethylene-vinyl acetate copolymers, ethylene-vinyl alcohol copolymers, and ethylene-allyl copolymers such as ethylene-allyl alcohol copolymers, ethylene-allyl acetone copolymers, ethylene-allyl benzene copolymers ethylene-allyl ether copolymers, ethylene-acrylic copolymers and polyoxy-methylene, polycondensation polymers, such as, polyesters, including polyethylene terephthalate, polybutylene terephthalate, polyurethanes and polycarbonates. In some applications for thermally processable elements it is desirable to select a polymer or copolymer that has an index of refraction that substantially matches the index of refraction of the material of the layer in which it is coated.

Another method of preparing matte particles in accordance with this invention is by a limited coalescence technique where polyaddition polymerizable monomer or monomers are added to an aqueous medium containing a particulate suspending agent to form a discontinuous (oil droplet) phase in a continuous (water) phase. The mixture is subjected to shearing forces, by agitation, homogenization and the like to reduce the size of the droplets. After shearing is stopped an equilibrium is reached with respect to the size of the droplets as a result of the stabilizing action of the particulate suspending agent in coating the surface of the monomer droplets. The material of the desired binder is added and polymerization is completed to form an aqueous suspension of polymer particles. This process is described in U.S. Pat. Nos. 2,932,629; 5,279,934; and 5,378,577, the entire disclosures of which are incorporated herein by reference.

A still further method of preparing matte particles in accordance with this invention is the "polymer suspension" technique, a suitable polymer is dissolved in a solvent and this solution is dispersed as fine water-immiscible liquid droplets in an aqueous solution that contains colloidal silica as a stabilizer. Equilibrium is reached and the size of the droplets is stabilized by the action of the colloidal silica coating the surface of the droplets. The material of the desired binder is added and the solvent is removed from the droplets by evaporation or other suitable technique resulting in polymeric particles having a uniform coating thereon of colloidal silica and binder material.

Useful solvents for the polymer suspension process are those that dissolve the polymer, which are immiscible with water and which are readily removed from the polymer droplets such as, for example, chloromethane, dichloromethane, ethylacetate, n-propyl acetate, vinyl chloride, methyl ethyl ketone, trichloromethane, carbon tetrachloride, ethylene chloride, trichloroethane, toluene, xylene, cyclohexanone, 2-nitropropane and the like. Particularly useful solvents are dichloromethane, ethyl acetate and n-propyl acetate because they are good solvents for many polymers while at the same time, they are immiscible with water. Further, their volatility is such that they can be readily removed from the discontinuous phase droplets by evaporation.

In certain embodiments of the invention, in addition to the film forming binder, the particle surface may be surrounded with a layer of colloidal inorganic particles as described in U.S. Pat. Nos. 5,288,598, 5,378,577, 5,563,226 and 5,750,378 the entire disclosures of which are incorporated herein by reference, or a layer of colloidal polymer latex particles as described in U.S. Pat. No. 5,279,934 the entire disclosure of which is incorporated herein by reference.

As described in the '577 patent, any suitable colloidal inorganic particles can be used to form the particulate layer on the polymeric core, such as, for example, silica, alumina, alumina-silica, tin oxide, titanium dioxide, zinc oxide and the like. Colloidal silica is preferred for several reasons including ease of preparation of the coated polymeric particles and narrow size distribution.

The matte particles utilized in this invention preferably have a mean diameter in the range of from about 0.3 to about 20 micrometers ($\mu$m), more preferably in the range of from about 0.5 to about 10 $\mu$m and most preferably in the range of from about 0.5 to about 7 $\mu$m. They are preferably utilized in an amount of from about 5 to about 200 mg/m$^2$ and more preferably from about 10 to about 125 mg/m$^2$. The mean diameter is defined as the mean of the volume distribution.

In embodiments of the invention in which both the protective overcoat and backing layers contain matte particles, the size of the matte particles of one of the layers may differ from the size of the matte particles in the other. For example, it may desirable to have matte particles in the backing layer of greater that 4 $\mu$m and particles in the overcoat layer less than 2 $\mu$m. For example, the matte particles in the protective backing layer can be about 5 $\mu$m and the matte particles in the protective overcoat layer can be about 1.5 $\mu$m.

The thermally processable imaging element of this invention can be of the type in which an image is formed by imagewise heating of the element or of the type in which an image is formed by imagewise exposure to light followed by uniform heating of the element. The latter type of element is commonly referred to as a photothermographic element.

Typical photothermographic imaging elements within the scope of this invention comprise at least one imaging layer containing in reactive association in a binder, preferably a binder comprising hydroxyl groups, (a) photographic silver halide prepared in situ and/or ex situ, (b) an image-forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent, and (c) an optional toning agent. References describing such imaging elements include, for example, U.S. Pat. Nos. 3,457,075; 4,459,350; 4,264,725 and 4,741,992 and *Research Disclosure*, June 1978, Item No. 17029.

The photothermographic element comprises a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, *Research Disclosure*, December 1978, Item No. 17029 and *Research Disclosure*, June 1978, Item No. 17643. Tabular grain photosensitive silver halide is also useful, as described in, for example, U.S. Pat. No. 4,435,499. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Pat. No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate. Combinations of organic silver salt oxidizing agents are also useful. Examples of useful organic silver salt oxidizing agents that are not organic silver salts of fatty acids are silver benzoate and silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0.1 to 100 moles of organic silver salt oxidizing agent per mole of silver halide in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1 -phenyl-3-pyrazolidone and 4-methyl-4-hydroxymethyl- 1 -phenyl-3-pyrazolidone; and sulfonamidophenols and other organic reducing agents known to be useful in photothermographic elements, such as described in U.S. Pat. No. 3,933,508, U.S. Pat. No. 3,801,321 and *Research Disclosure*, June 1978, Item No. 17029. Combinations of organic reducing agents are also useful in the photothermographic element.

Preferred organic reducing agents in the photothermographic element are sulfonamidophenol reducing agents, such as described in U.S. Pat. No. 3,801,321. Examples of useful sulfonamidophenol reducing agents are 2,6-dichloro-4-benzene-sulfonamidophenol; benzenesulfonamidophenol; and 2,6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt and the particular oxidizing agent.

The photothermographic element preferably comprises a toning agent, also known as an activator-toner or toner-accelerator. Combinations of toning agents are also useful in the photothermographic element. Examples of useful toning agents and toning agent combinations are described in, for example, *Research Disclosure*, June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The thermally processable elements as described preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly (vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly (vinylpyrrolidone), ethyl cellulose, polystyrene, poly (vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The thermally processable element can comprise a variety of supports. Examples of useful supports are poly (vinylacetal) film, polystyrene film, poly (ethyleneterephthalate) film, poly(ethylene naphthalate) film, polycarbonate film, and related films and resinous materials, as well as paper, glass, metal, and other supports that withstand the thermal processing temperatures.

The layers of the thermally processable element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element. Useful sensitizing dyes are described in, for example, *Research Disclosure*, June 1978, Item No. 17029 and *Research Disclosure*, December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

The thermally processable elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 140° C.

In the case of a thermographic element, the thermal energy source and means for imaging can be any imagewise thermal exposure source and means that are known in the thermographic imaging art. The thermographic imaging means can be, for example, an infrared heating means, laser, microwave heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the thermally processable element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

In preferred embodiments of the invention, the protective layer is a backing layer which preferably has a glass transition temperature (Tg) of greater than 50° C., more preferably greater than 100° C.

In certain embodiments of the invention, the protective layer contains a dye. Dyes which can be used include dyes from the following dye classes: anthraquinone, formazan, metal-complexed formazans, azo, metal-complexed azo, phthalocyanine, metalophthalocyanine, merocyanine, oxonol, cyanine, hemicyanine, indigo, metal dithiolene, squarylium, methine, azamethine, azacyanine, diazacyanine, oxazine, phenazine, thioxazine, rhodamine, fluoran, pyryllium, thiapyryllium, selenapyryllium, telluropyryllium, benzoquinone, anthrapyridone, stilbene, triphenylmethane, oxoindolizine, indolizine, prophyrazine, thioindigo, croconate, styryl, azastyryl and perlene.

Particularly preferred dyes are, for example, Victoria Pure Blue BO, Victoria Brilliant Blue G, Serva Blue WS, Aniline Blue, Page Blue G-90 and Methylene Blue and phthalocyanine dyes as described in commonly assigned, copending application Ser. No. 08978,653, filed Nov. 26, 1007, the entire disclosure of which are incorporated herein by reference.

The amount of dye, if a dye is present in the protective layer, preferably comprises about 1 to about 100, more preferably about 5 to about 50 and most preferably about 10 to about 30 mg/m$^2$.

The binder material, e.g., poly(vinyl alcohol), can under certain conditions be subject of biological degradation. For this reason it is desirable to add a biocide to a solution of the binder material prior to addition of the binder material to the core of the matte particles or prior to use of the binder material in the coating composition used to form the protective layer(s). As described in commonly assigned, copending application Ser. No. 08/915,209, filed Aug. 20, 1997 , a particularly suitable biocide is a mixture of compounds of the formulae I and II:

I

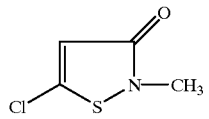

II

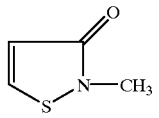

Preferably the ratio between the compound I and the compound of formula II is 50:50 to 90:10. In particularly preferred embodiments of the invention the ratio between the compound of formula I and compound II is 75:25.

The amount of biocide used in the poly(vinyl alcohol) composition is from about 1 to about 1500 ppm, relative to the amount of poly(vinyl alcohol), more preferably about 1 to about 1000 and most preferably about 10 to about 15.

The following examples illustrate the preparation of matte particles having a shell other than gelatin, imaging elements containing such matte particles and evaluation of image quality thereof.

EXAMPLE 1

To 4,040 g of methyl methacrylate is added 7.22 g Aerosol OT-100 (sodium dioctyl sulfosuccinate) and 20.2 g lauroyl peroxide. This mixture is then added to 12,120 g of distilled water and stirred for 5 minutes followed by passing through a Gaulin colloid mill running at 3,600 rpm, 0.01" gap and 1 gal/min feed rate. This milled suspension is then split into six aliquots of 2,500 g each, either 35% swollen gelatin or poly(vinyl alcohol) (PVA) is added as per Table 1, and the suspension is reacted for 16 hours at 52° C. with paddle stirring at 150 rpm. The flask is then heated to 80° C. for 2 hours and cooled. The resulting polymer particles have a volume average mean size of approximately 1.4 $\mu$m.

TABLE 1

| Sample number | Polymer added | Amount added |
|---|---|---|
| 1 (inv.) | poly(vinyl alcohol) | 62.3 g |
| 2 (inv.) | poly(vinyl alcohol) | 31.2 g |
| 3 (inv.) | poly(vinyl alcohol) | 20.8 g |
| 4 (comp.) | 35% swollen gelatin | 178 g |
| 5 (comp.) | 35% swollen gelatin | 89 g |
| 6 (comp.) | 35% swollen gelatin | 59.3 g |

EXAMPLE 2

Matte particles comprising a polymeric core and a shell of gelatin, poly(acrylic acid), poly(vinyl pyrrolidone) or poly (vinyl alcohol) are prepared by the following procedure. To a mixture of 2,041 g of methyl methacrylate and 226.8 g of ethylene glycol dimethacrylate is added 5.4 g Aerosol OT-100 (sodium dioctyl sulfosuccinate) and 9.45 g lauroyl peroxide. This mixture is then added to 6,809 g of distilled water and stirred for 5 minutes followed by passing through a Gaulin colloid mill running at 3,000 rpm, 0.01" gap and 1 gal/min feed rate. This milled suspension is then split into six aliquots of 1,500 g each, a water soluble polymer is added as per Table 2, and the suspension reacted for 16 hours at 50° C. with paddle stirring at 125 rpm. The flask is then heated 60° C. for 1 hour followed by heating to 80° C. for 2 hours and cooled. The resulting polymer particles have a volume average mean size of approximately 1.6 μm.

TABLE 2

| Sample number | Polymer added | Amount added |
|---|---|---|
| 7 (comp.) | None | — |
| 8 (comp.) | 12.5% gelatin solution | 135 g |
| 9 (comp.) | 5% poly(acrylic acid) solution | 338 g |
| 10 (comp.) | 20% poly(vinyl pyrrolidone) solution | 84.4 g |
| 11 (comp.) | 10% poly(vinyl alcohol) solution | 169 g |

The mattes of preparations 7 to 11 are coated on a support using gelatin as the binder and processed. Matte adhesion is evaluated by examining the surface of each sample with an optical microscope and counting the number of craters or pits on the surface left by removed matte per unit area. Results are shown in Table 3

TABLE 3

| Sample number | Amount Coated mg/m$^2$ | PITS #/0.46 mm$^2$ |
|---|---|---|
| 7 (comp.) | 5 | 39 |
| 8 (comp.) | 5 | 0 |
| 9 (comp.) | 5 | 0 |
| 10 (comp.) | 5 | 0 |
| 11 (comp.) | 5 | 62 |

The data in Table 3 show that gelatin, polyacrylic acid, and polyvinyl pyrrolidone provide for excellent adhesion to gelatin binders. Poly(vinyl alcohol), however, not only doesn't improve adhesion but is shown to be inferior to using no hydrophilic colloid (Sample 7).

EXAMPLE 3

This example compares the stability in aqueous PVA binder solutions of polymer mattes having a gelatin shell (GEL) and polymer mattes having a poly(vinyl alcohol) shell (PVA).

Four different poly(vinyl alcohol) batches (A, B, C and D) having different levels of bacterial and viral growth as shown in Table 4 were diluted with water. The matte was added to the resulting solution.

TABLE 4

| Sample number | Bacterial Growth | Fungal Growth |
|---|---|---|
| A | 10 | <10 |
| B | $1.36 \times 10^6$ | <10 |
| C | $9.9 \times 10^3$ | 330 |
| D | $9.5 \times 10^4$ | 110 |

Microscopic evaluation of the slurry was done at 400×to determine whether the matte particles had agglomerated and if so by how much. The following rating scale was used:

1=no aggregates
2=doublets (<2 μm)
3=2–5 μm
4=large loose flocs (>50 μm)

The results are given in Table 5.

TABLE 5

| Matte Sample number | A | B | C | D |
|---|---|---|---|---|
| 1 (inv.) | 1 | 1 | 1 | 1 |
| 2 (inv.) | 1 | 1 | 1 | 1 |
| 3 (inv.) | 1 | 1 | 1 | 1 |
| 4 (comp.) | 2 | 2 | 3 | 3 |
| 5 (comp.) | 3 | 2 | 2 | 4 |
| 6 (comp.) | 2 | 3 | 4 | 4 |

This example demonstrates the particles according to the invention did not agglomerate even in PVA solutions degraded by biological growth while prior art particles agglomerate under these conditions.

The invention has been described in detail with particular reference to certain preferred embodiments thereof, but it will be understood that variations and modifications can be effected within the spirit and scope of the invention.

What is claimed is:

1. A thermally processable imaging element comprising:
(1) a support;
(2) a thermally processable imaging layer on one side of the support; and
(3) a protective layer comprising:
(A) a film-forming binder;
(B) matte particles comprising a core surrounded by said film-forming binder;
wherein the binder is other than gelatin.

2. An imaging element according to claim 1, wherein the protective layer is a protective overcoat layer.

3. An imaging element according to claim 1, wherein the binder comprises poly(vinyl alcohol).

4. An imaging element according to claim 3, wherein the film-forming binder additionally contains poly(silicic acid).

5. An imaging element according to claim 1, wherein the matte particles are 0.3 to about 20 micrometers.

6. An imaging element according to claim 1, wherein the polymer core is of polymethylmethacrylate.

7. An imaging element according to claim 6, wherein the polymethylmethacrylate is crosslinked.

8. An imaging element according to claim 1, wherein the protective layer is a protective backing layer.

9. An imaging element according to claim 8, wherein the element further comprises a protective overcoat layer comprising:
(A) a film-forming binder;
(B) matte particles comprising a core surrounded by said film-forming binder.

10. An imaging element according to claim 9, wherein the matte particles in the backing layer are greater than about 4 μm and the matte particles in the overcoat layer are less than about 2 μm.

* * * * *